US006655370B1

(12) United States Patent
Beckwith

(10) Patent No.: US 6,655,370 B1
(45) Date of Patent: Dec. 2, 2003

(54) FIRECRACKER LAUNCHING DEVICE

(76) Inventor: Darry D. Beckwith, 8918 McTairie Dr., Baton Rouge, LA (US) 70810

( * ) Notice: Subject to any disclaimer, the term of this patent is extended or adjusted under 35 U.S.C. 154(b) by 0 days.

(21) Appl. No.: 10/053,917

(22) Filed: Jan. 24, 2002

(51) Int. Cl.[7] ..... F41B 7/00
(52) U.S. Cl. ..... 124/16; 124/36
(58) Field of Search ..... 124/4, 5, 16, 36, 124/79

(56) References Cited

U.S. PATENT DOCUMENTS 1,091,512 A * 3/1914 Hoffman
1,100,728 A * 6/1914 Gould
1,457,674 A * 6/1923 Kennedy et al.
2,082,818 A * 6/1937 Atwell
3,245,170 A * 4/1966 MacDonald
3,638,633 A * 2/1972 Clark ..... 124/4
3,794,325 A * 2/1974 Stender
4,995,371 A * 2/1991 Kuizinas ..... 124/36 X

* cited by examiner

*Primary Examiner*—John A. Ricci

(57) ABSTRACT

A firecracker launching device for launching a firecracker up to 50 feet so that it would be safely exploded. The firecracker launching device includes a handgun-shaped member having an elongate barrel, and a handgrip stock member. The barrel has an internal cavity, and a longitudinal opening through its top wall and into the cavity. A launching lever is pivotally mounted in the cavity, toward the front of the barrel, the lever having a forward lug member, a rearward catch member, and a firecracker receiving slot. A trigger is pivotally mounted in the cavity, rearward of the lever, the trigger having a latch member engageable with the catch member of the lever, and a finger-engaging portion. A spring extends between the lug member and the trigger, so that when the trigger is pulled, the latch will disengage from the catch, to pivot the lever forward under bias from the spring, to launch a firecracker.

4 Claims, 2 Drawing Sheets

FIRECRACKER LAUNCHING DEVICE

BACKGROUND OF THE INVENTION

1. Field of the Invention

The present invention relates to firecracker launchers and more particularly pertains to a new firecracker launching device for launching a firecracker up to 50 feet so that it would be safely exploded.

2. Description of the Prior Art

The use of firecracker launchers is known in the prior art. More specifically, firecracker launchers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 8,333,372; U.S. Pat. No. 1,091,512; U.S. Pat. No. 4,369,592; U.S. Pat. No. 3,594,033; U.S. Pat. No. 4,495,868; and U.S. Pat. No. 2,758,585. None of the prior art hurls a firecracker a safe distance from the user before exploding unlike the present invention.

While these devices fulfill their respective, particular objectives and requirements, the aforementioned patents do not disclose a new firecracker launching device. The inventive device includes a handgun-shaped member having an elongate barrel and a handgrip stock member attached to the elongate barrel; and an assembly for launching a firecracker from the elongate barrel; all features not described nor suggested by the prior art.

In these respects, the firecracker launching device according to the present invention substantially departs from the conventional concepts and designs of the prior art, and in so doing provides an apparatus primarily developed for the purpose of launching a firecracker up to 50 feet so that it would be safely exploded.

SUMMARY OF THE INVENTION

The general purpose of the present invention, which will be described subsequently in greater detail, is to provide a new firecracker launching device apparatus and method which has many of the advantages of the firecracker launchers mentioned heretofore and many novel features that result in a new firecracker launching device which is not anticipated, rendered obvious, suggested, or even implied by any of the prior art firecracker launchers, either alone or in any combination thereof.

There has thus been outlined, rather broadly, the more important features of the firecracker launching device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new firecracker launching device apparatus and method which has many of the advantages of the firecracker launchers mentioned heretofore and many novel features that result in a new firecracker launching device which is not anticipated, rendered obvious, suggested, or even implied by any of the prior art firecracker launchers, either alone or in any combination thereof.

Still another object of the present invention is to provide a new firecracker launching device for launching a firecracker up to 50 feet so that it would be safely exploded.

Still yet another object of the present invention is to provide a new firecracker launching device that is easy and convenient to use.

Even still another object of the present invention is to provide a new firecracker launching device that prevents injury to the user by hurling the firecracker a safe distance away from the user before exploding.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
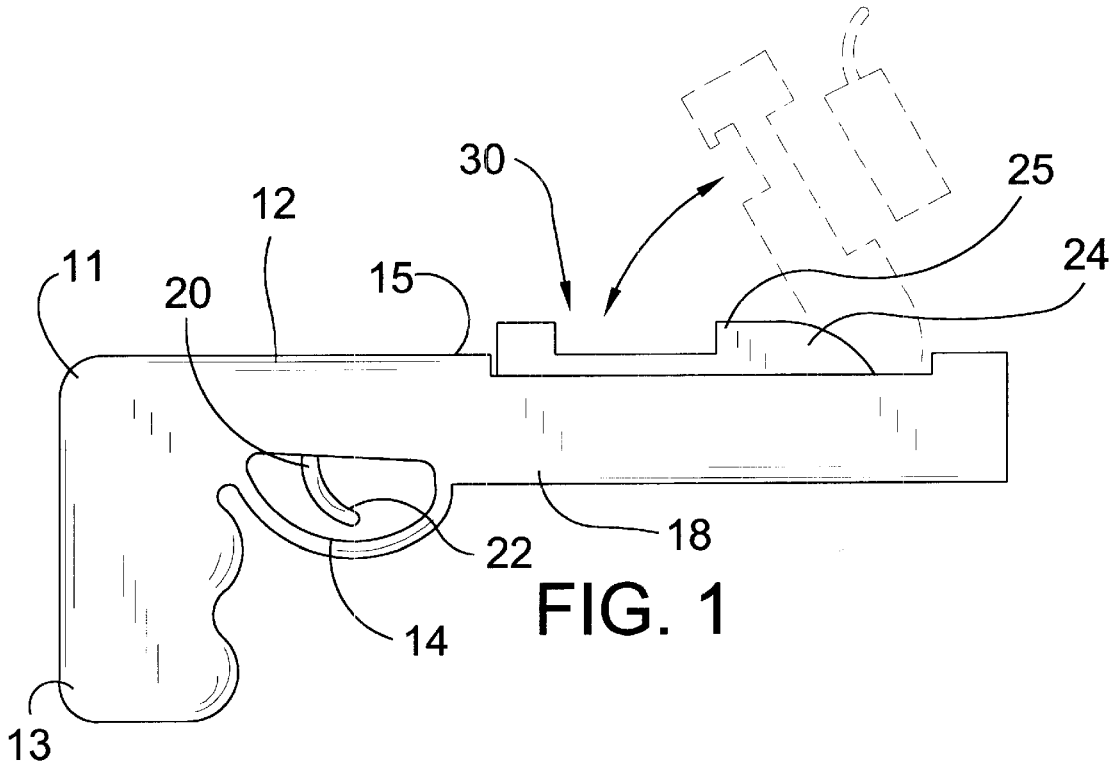
FIG. 1 is a side elevational view of a new firecracker launching device according to the present invention and shown in use.
Figure 2:
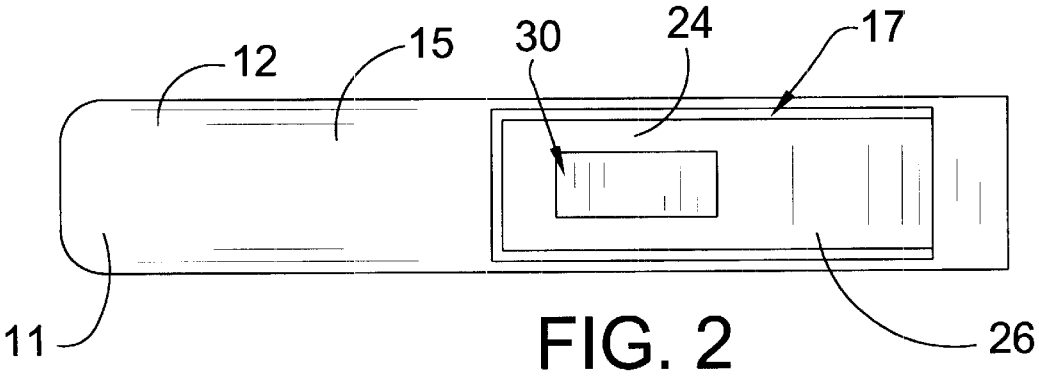
FIG. 2 is a top plan view of the present invention.
Figure 3:
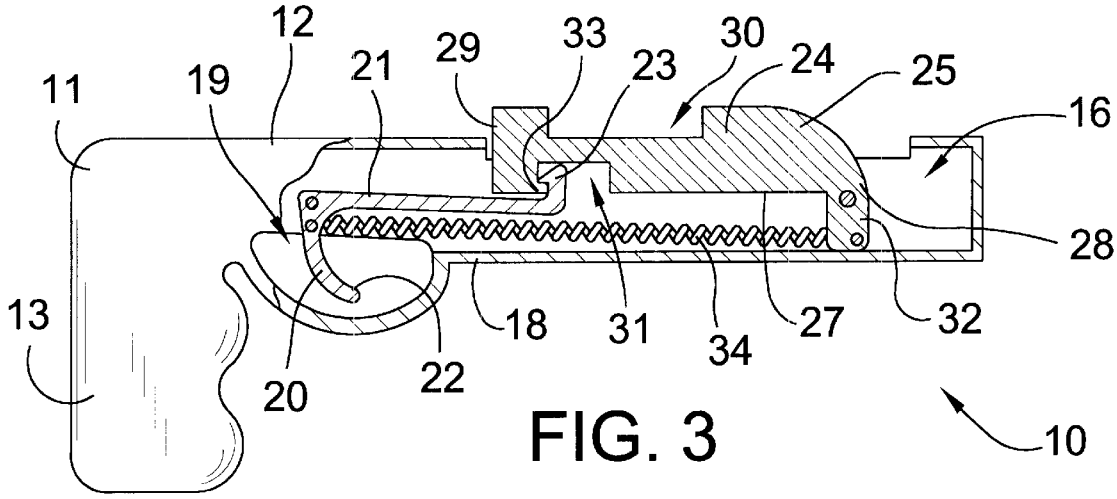
FIG. 3 is a side cross-sectional view of the present invention.

With reference now to the drawings, and in particular to FIGS. 1 through 3 thereof, a new firecracker launching device embodying the principles and concepts of the present invention and generally designated by the reference numeral 10 will be described.

As best illustrated in FIGS. 1 through 3, the firecracker launching device 10 generally comprises a handgun-shaped member 11 having an elongate barrel 12 and a handgrip stock member 13 integrally and conventionally attached to the elongate barrel 12. The handgun-shaped member 11 further includes a trigger guard member 14 is integrally and conventionally attached at a junction of the handgrip stock member 13 and the elongate barrel 12. The elongate barrel 12 has a top wall 15, and also has an internal cavity 16, and a longitudinal opening 17 being disposed through the top wall 15 and into the cavity 16 of the elongate barrel 12.

A means for launching a firecracker from the elongate barrel 12 includes a trigger 20, a latch member 23 being conventionally attached to the trigger 20, a lever 23 being pivotally and conventionally attached to the elongate barrel 12, and a spring member 34 being conventionally attached to the trigger 20 and to the lever 23. The trigger 20 includes an elongate shaft 21 being pivotally and conventionally disposed in the cavity 16 of the elongate barrel 12, and also includes an arcuate finger-hold end portion 22 being conventionally and integrally attached to a first end of the elongate shaft 21 and being movably disposed through an opening 19 in a bottom wall 18 of the elongate barrel 12. The latch member 23 is integrally attached to a second end of the elongate shaft 21 and is curved back upon a portion of the elongate shaft 21. The lever 24 includes an elongate main body 25 having a top side 26 and a bottom side 27, and also includes a lug member 32 being conventionally and integrally attached at a first end 28 of the elongate main body 24 and being disposed generally perpendicular to the elongate main body 25 and further being pivotally and conventionally attached in the cavity 16 near a front end of the elongate barrel 12. The elongate main body 25 is rounded at a junction of the top side 15 and the first end 28 to facilitate unhindered pivoting of the lever 24. The elongate main body 25 further includes a longitudinal slot 30 being disposed in the top side 26 thereof and being adapted to removably receive a firecracker therein, and also includes a first slot 31 being disposed in the bottom side 27 and near a second end 29 of the elongate main body 25. The lever 24 further includes a catch member 33 being integrally attached to a wall defining the first slot 31 and being disposed in the first slot 31. The latch member 23 is engagable to the catch member 33 to pivotally retain the lever 24 in the cavity 16 of the elongate barrel 12 for launching a firecracker away from the firecracker launching device 10.

In use, the user cocks the lever 24 using the latch member 23 which engages the catch member 33, and places the firecracker in the longitudinal slot 30. The user then lights the firecracker and pulls the trigger 20 which disengages the latch member 23 from the catch member 33 with the spring member 34 pulling back on the lug member 32 thus pivotally springing the lever 24 out of the cavity 16 of the elongate barrel 12 and throwing or hurling the firecracker a safe distance away from the user before exploding.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the firecracker launching device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firecracker launching device comprising:

a handgun-shaped member having an elongate barrel and a handgrip stock member attached to said elongate barrel, said elongate barrel having a top wall, and also having an internal cavity, and a longitudinal opening being disposed through said top wall and into said cavity of said elongate barrel; and a means for launching a firecracker from said elongate barrel including a trigger, a latch member being attached to said trigger, a lever being pivotally attached to said elongate barrel, and a spring member being attached to said trigger and to said lever, said trigger including an elongate shaft being pivotally disposed in said cavity of said elongate barrel, and also including an arcuate finger-hold end portion being attached to a first end of said elongate shaft and being movably disposed through an opening in a bottom wall of said elongate barrel, said latch member being attached to a second end of said elongate shaft and being curved back upon a portion of said elongate shaft, said lever including an elongate main body having a top side and a bottom side, and also including a lug member being attached at a first end of said elongate main body and being disposed generally perpendicular to said elongate main body and further being pivotally attached in said cavity near a front end of said elongate barrel, said elongate main body being rounded at a junction of said top side and said first end to facilitate unhindered pivoting of said lever.

2. A firecracker launching device as described in claim 1, wherein said elongate main body further includes a longitudinal slot being disposed in said top side thereof and being adapted to removably receive a firecracker therein, and also includes a first slot being disposed in said bottom side and near a second end of said elongate main body.

3. A firecracker launching device as described in claim 2, wherein said lever further includes a catch member being attached to a wall defining said first slot and being disposed in said first slot, said latch member being engageable to said catch member to pivotally retain said lever in said cavity of said elongate barrel for launching a firecracker away from said firecracker launching device.

4. A firecracker launching device as described in claim 1, wherein said spring member has a first end which is attached to said arcuate finger-hold end portion of said trigger, and has a second end which is attached to said lug member for pivotally ejecting said lever a from said cavity of said elongate barrel.

* * * * *